US007323829B2

(12) United States Patent
Moyer et al.

(10) Patent No.: US 7,323,829 B2
(45) Date of Patent: Jan. 29, 2008

(54) MINIMIZING BOND WIRE POWER LOSSES IN INTEGRATED CIRCUIT FULL BRIDGE CCFL DRIVERS

(75) Inventors: James C. Moyer, San Jose, CA (US); Wei Chen, Campbell, CA (US)

(73) Assignee: Monolithic Power Systems, Inc., San Jose, CA (US)

( * ) Notice: Subject to any disclaimer, the term of this patent is extended or adjusted under 35 U.S.C. 154(b) by 330 days.

(21) Appl. No.: 11/205,779

(22) Filed: Aug. 16, 2005

(65) Prior Publication Data

US 2006/0038502 A1 Feb. 23, 2006

Related U.S. Application Data

(60) Provisional application No. 60/603,958, filed on Aug. 23, 2004, provisional application No. 60/603,409, filed on Aug. 20, 2004.

(51) Int. Cl.
*H05B 37/02* (2006.01)

(52) U.S. Cl. ..... 315/291; 315/219; 315/224; 315/DIG. 7

(58) Field of Classification Search ..... 315/219, 315/224, 291, DIG. 5, DIG. 7
See application file for complete search history.

(56) References Cited

U.S. PATENT DOCUMENTS 5,528,192 A 6/1996 Agiman et al.
5,615,093 A 3/1997 Nalbant
5,619,402 A 4/1997 Liu
5,757,173 A 5/1998 Agiman
5,892,336 A 4/1999 Lin et al.
5,923,129 A 7/1999 Henry
5,930,121 A 7/1999 Henry
6,104,146 A 8/2000 Chou et al.
6,198,234 B1 3/2001 Henry
6,198,245 B1 3/2001 Du et al.
6,259,615 B1 7/2001 Lin
6,307,765 B1 10/2001 Choi
6,396,722 B2 5/2002 Lin
6,459,602 B1 10/2002 Lipcsei
6,469,922 B2 10/2002 Choi
6,501,234 B2 12/2002 Lin et al.
6,507,173 B1 1/2003 Spiridon et al.
6,515,881 B2 2/2003 Chou et al.
6,531,831 B2 3/2003 Chou et al.
6,559,606 B1 5/2003 Chou et al.
6,570,344 B2 5/2003 Lin
6,654,268 B2 11/2003 Choi
6,657,274 B2 12/2003 Comeau et al.
6,756,769 B2 6/2004 Bucur et al.
6,781,325 B2 8/2004 Lee et al.
6,809,938 B2 10/2004 Lin et al.

(Continued)

*Primary Examiner*—David H. Vu
(74) *Attorney, Agent, or Firm*—Perkins Coie LLP; Zhou Lu

(57) ABSTRACT

A technique is described that reduces parasitic losses in circuits used to drive current through a load. An example of a system according to the technique includes four switches in series with five pins such that one pin is connected to ground. An example of an apparatus according to the technique may include four switches in series with two switches connected to ground and to a load and two switches connected to a power source. An example of a method according to the technique involves producing a voltage waveform having three phases.

24 Claims, 18 Drawing Sheets

U.S. PATENT DOCUMENTS 6,853,047 B1 2/2005 Comeau et al.
6,856,519 B2 2/2005 Lin et al.
6,864,669 B1 3/2005 Bucur
6,870,330 B2 3/2005 Choi
6,873,322 B2 3/2005 Hartular
6,876,157 B2 4/2005 Henry
6,888,338 B1 5/2005 Popescu-Stanesti et al.
6,897,698 B1 5/2005 Gheorghiu et al.
6,900,993 B2 5/2005 Lin et al.
6,906,497 B2 6/2005 Bucur et al.
6,936,975 B2 8/2005 Lin et al.
6,946,806 B1 9/2005 Choi
6,956,336 B2 * 10/2005 Ribarich ..... 315/247
6,979,959 B2 12/2005 Henry
6,999,328 B2 2/2006 Lin
7,023,709 B2 4/2006 Lipcsei et al.
7,057,611 B2 6/2006 Lin et al.
7,061,183 B1 6/2006 Ball
7,075,245 B2 7/2006 Liu
7,095,392 B2 8/2006 Lin
7,098,605 B2 * 8/2006 Oh ..... 315/291
7,112,929 B2 9/2006 Chiou
7,112,943 B2 9/2006 Bucur et al.
7,120,035 B2 10/2006 Lin et al.
7,126,289 B2 10/2006 Lin et al.
7,141,933 B2 11/2006 Ball
7,157,886 B2 1/2007 Agarwal et al.
7,161,309 B2 1/2007 Chiou et al.
7,173,382 B2 2/2007 Ball
7,183,724 B2 2/2007 Ball
7,183,727 B2 2/2007 Ferguson et al.
7,187,139 B2 3/2007 Jin
7,187,140 B2 3/2007 Ball
7,190,123 B2 3/2007 Lee et al.
7,200,017 B2 4/2007 Lin
2002/0180380 A1 12/2002 Lin
2005/0030776 A1 2/2005 Lin
2005/0093471 A1 5/2005 Jin
2005/0093482 A1 5/2005 Ball
2005/0093484 A1 5/2005 Ball
2005/0151716 A1 7/2005 Lin
2005/0174818 A1 8/2005 Lin et al.
2005/0225261 A1 10/2005 Jin
2006/0202635 A1 9/2006 Liu
2006/0232222 A1 10/2006 Liu et al.
2006/0279521 A1 12/2006 Lin
2007/0001627 A1 1/2007 Lin et al.
2007/0046217 A1 3/2007 Liu
2007/0047276 A1 3/2007 Lin et al.
2007/0085493 A1 4/2007 Kuo et al.

* cited by examiner

MINIMIZING BOND WIRE POWER LOSSES IN INTEGRATED CIRCUIT FULL BRIDGE CCFL DRIVERS

CROSS-REFERENCE TO RELATED APPLICATIONS

This Application claims the benefit of U.S. Provisional Patent Application No. 60/603,409 filed Aug. 20, 2004, and U.S. Provisional Patent Application No. 60/603,958 filed Aug. 23, 2004, each of which is incorporated by reference in its entirety.

BACKGROUND

Circuits are used to drive a load by supplying a potential across the load. Many loads are driven with alternating current in order to modulate the power delivered to the load. Power inverters are often used to generate such alternating current. One type of power inverter is the full bridge circuit. Some full bridge circuits use fast-switching transistors in order to produce alternating current of high frequency.

One type of load that can be driven by a full bridge power inverter is a fluorescent lamp. Compared to incandescent lamps, fluorescent lamps are more efficient and emit less heat. Thus, fluorescent lamps may be more useful in situations in which batteries are being used to power the lamp. Fluorescent lamps that can be driven by such a power inverter include by way of example but not limitation the cold cathode fluorescent lamp (CCFL), the external electrode fluorescent lamp (EEFL), the flat fluorescent lamp (FFL), and other fluorescent lamps. The power inverter may also be used to drive banks of lamps.

CCFLs are commonly used in notebook computers as a backlight for a liquid crystal display (LCD). Portable notebook computer systems, for example, place increasing demands on higher efficiency, smaller size, lower costs, and increased battery life. A critical system that affects this is the power required by the display system. CCFLs are often used in such a display system because CCFLs are efficient and have a low heat emission, rugged electronics, and a long service life. Furthermore, CCFLs, and fluorescent lamps in general, emit light over a broad area and may contribute to even brightness across a notebook computer display screen. Driving a fluorescent lamp differentially (e.g., at both ends) can further improve evenness in brightness.

Today most of the CCFLs used in notebook computers are driven by a full bridge power supply that drives a magnetic step up transformer to apply the high voltage required by the CCFL. In this manner a notebook supply with a typical voltage of 7 to 22 V can tightly regulate a 600 VRMS voltage to the CCFL in an efficient manner. Full bridge power supplies in this application are typically made up of switches connected to one another and to other components of the circuit by bond wires. Parasitic losses occur in the bond wires and switches due to their resistance. Battery life in notebook computers can be prolonged by a reduction of these parasitic losses.

MP1010, MP1011, and MP1015 are manufactured by Monolithic Power Systems. These may be the only commercially available CCFL drivers that integrate the power transistors and control circuitry as of the filing date of this application.

SUMMARY

The following embodiments and aspects thereof are described and illustrated in conjunction with systems, tools, and methods that are meant to be exemplary and illustrative, not limiting in scope. In various embodiments, one or more of the above-described problems have been reduced or eliminated, while other embodiments are directed to other improvements.

A technique for reducing parasitic losses in a circuit involves arranging a switching network serially. An example of a system according to the technique involves a serially arranged network of four switches. By way of example but not limitation, the system may include five pins: Two pins are coupled to a power supply, two pins are coupled to a load, and one pin is grounded. The system may operate in one of two active phases, or a rest phase. In one active phase, a controller may direct current to flow from a first power supply pin to the ground pin, driving a load with a first potential thereby. In the other active phase, the controller may direct current to flow from a second power supply pin to the ground pin, driving a load with a second potential thereby. The first and second potentials may be of opposite polarity. The controller may alternate between active phases with a rest phase during which resonant current passes through the ground pin.

A folded full bridge apparatus constructed according to the technique may include a power source, multiple switches and a controller. The switches may be arranged in series in order to minimize parasitic losses in connections between the switches. The middle two switches may be connected between ground and a load. The switches at each end may be connected between a power source and the load. A controller may be coupled to the switches to control the opening and closing of the switches to drive the load with a first potential and a second potential thereby.

A method according to the technique may produce a voltage waveform that has three phases. The first phase may include driving a load with a first current through the ground pin. The third phase may include driving a load with a second current through the ground pin.

The proposed circuits can offer, among other advantages, minimizing parasitic bond wire losses in drivers, such as by way of example but not limitation CCFL full bridge drivers, or increasing battery lifetime. These and other advantages of the present invention will become apparent to those skilled in the art upon a reading of the following descriptions and a study of the several figures of the drawings.

BRIEF DESCRIPTION OF THE DRAWINGS

Embodiments of the invention are illustrated in the figures. However, the embodiments and figures are illustrative rather than limiting; they provide examples of the invention.

DETAILED DESCRIPTION OF THE INVENTION

In the following description, several specific details are presented to provide a thorough understanding of embodiments of the invention. One skilled in the relevant art will recognize, however, that the invention can be practiced without one or more of the specific details, or in combination with other methods, components, materials etc. In other instances, well-known structures, materials, implementations or operations are not shown or described in detail to avoid obscuring aspects of various embodiments of the invention.

Figure 1:
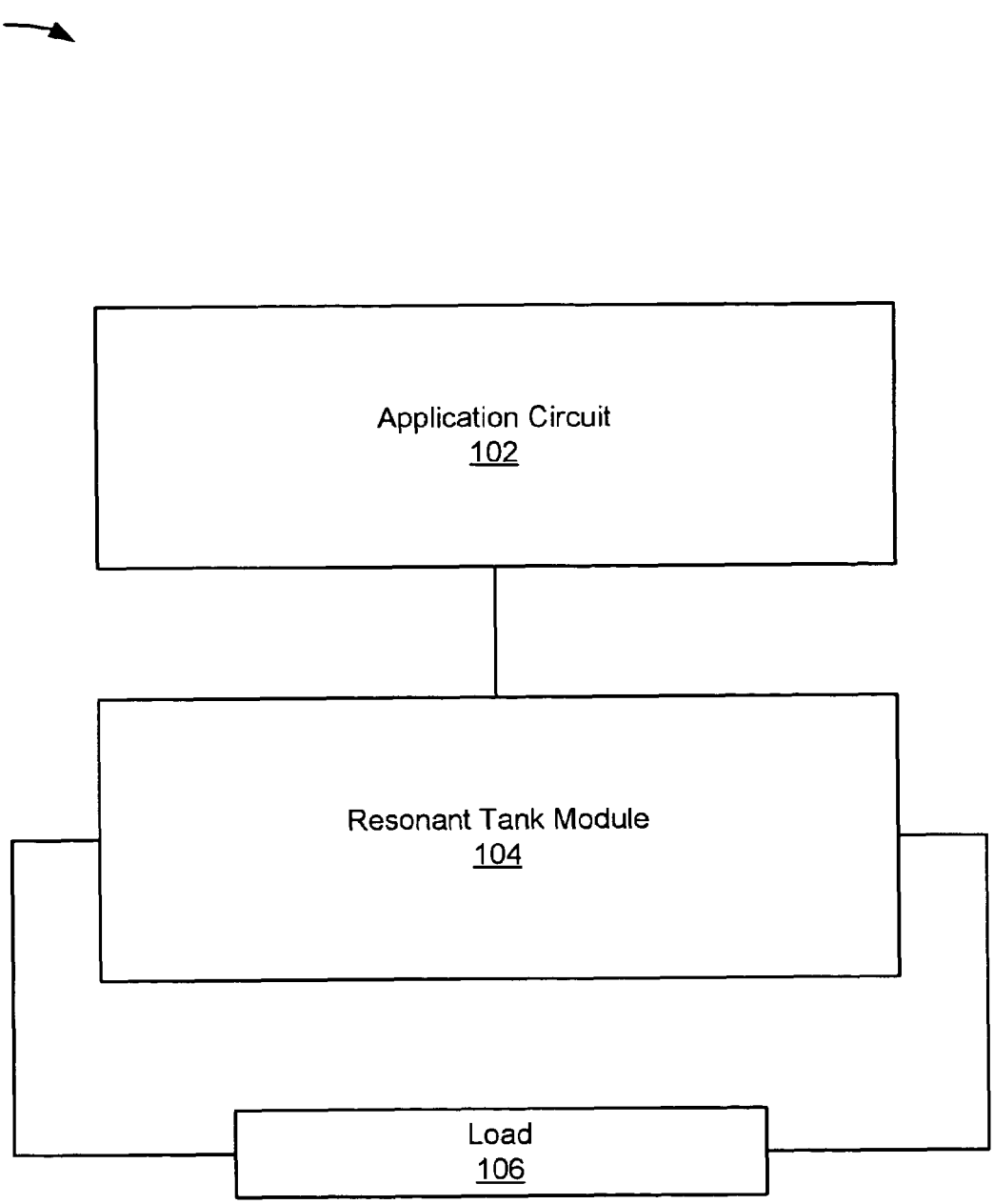
FIG. 1 depicts an example of a system for driving a load differentially.

FIG. 1 depicts an example of a system 100 for differentially driving a load 106. The system 100 includes an application circuit 102, a resonant tank module 104, and a load 106. The application circuit 102 is coupled to the resonant tank module 104. The resonant tank module 104 is coupled at both ends of a load 106. In operation, the application circuit 102 produces a square waveform voltage and the resonant tank 104 converts the square wave voltage into two out of phase analog signals used to differentially drive the load 106.

Figure 2A:
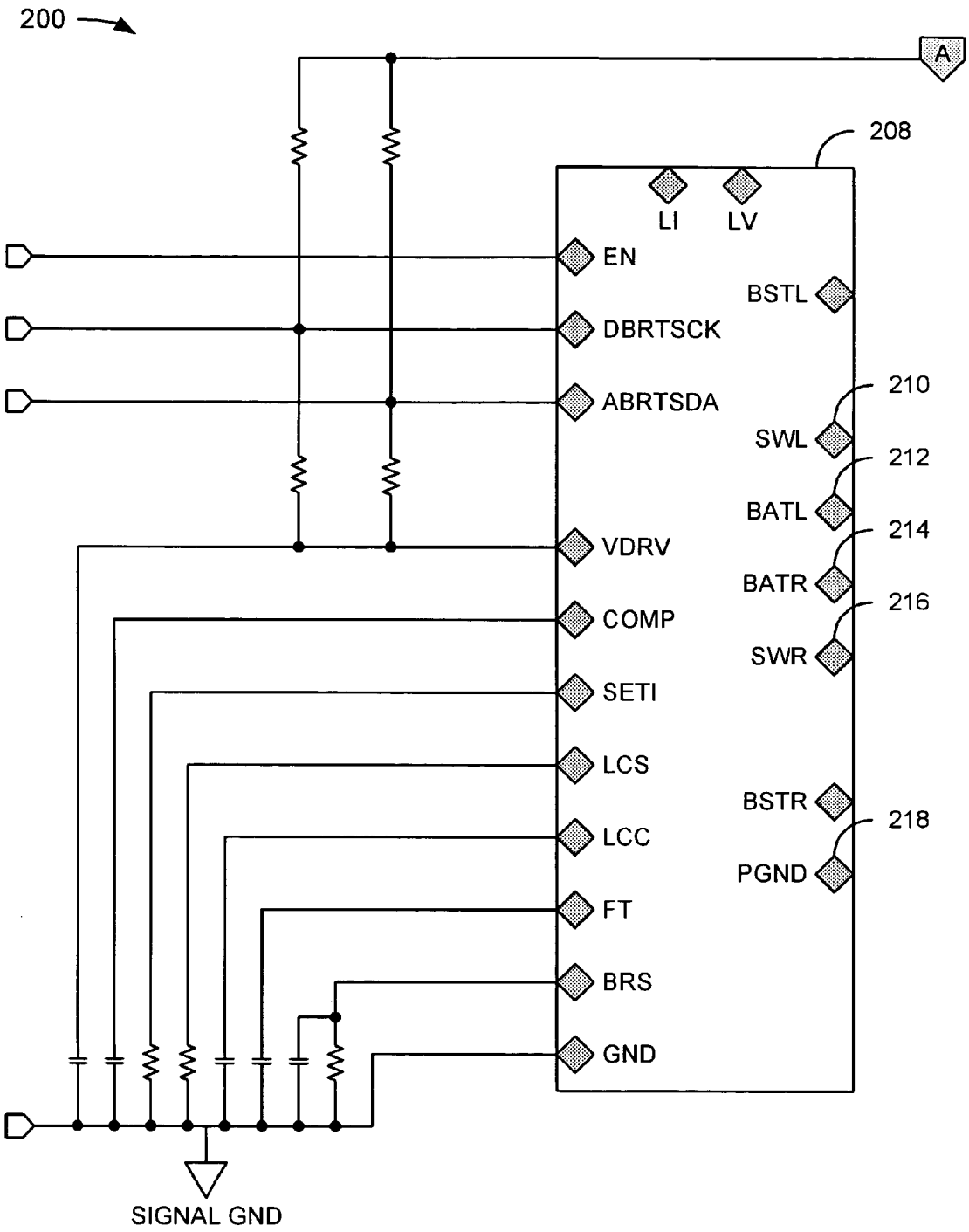
FIGS. 2A and 2B depict examples of an application circuit system.
Figure 2B:
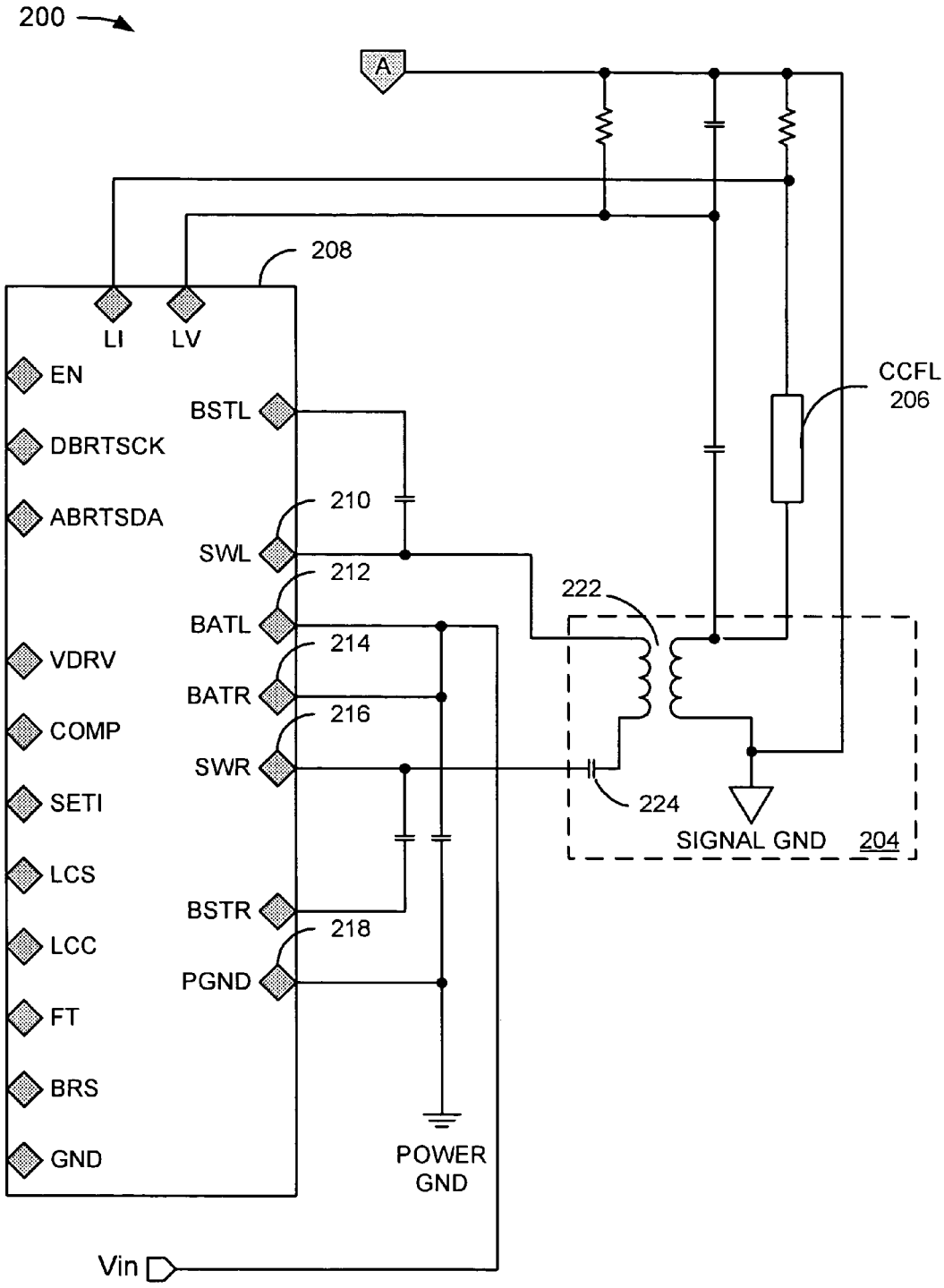

FIGS. 2A and 2B depict an example of an application circuit system 200. The system 200 includes a resonant tank module 204, a CCFL 206, a fixed frequency inverter module 208, and other exemplary components. In the example of FIG. 2B, the resonant tank module 204 is coupled to the CCFL 206 at two ends of the CCFL 206. The fixed frequency inverter 208 is represented in FIG. 2B as well as in FIG. 2A in order to enhance clarity. The fixed frequency inverter 208 is coupled to the resonant tank module 204.

In the example of FIG. 2B, the resonant tank module 204 includes a transformer 222 and capacitor 224. The capacitor 224 is coupled to the primary windings of the transformer 222. FIG. 2B depicts a non-limiting example of the resonant tank module 204, which may include different components or configurations in alternative embodiments.

In the example of FIG. 2B, the CCFL 206 includes a lamp. In alternative embodiments, the lamp may be a cold cathode fluorescent lamp (CCFL), an external electrode fluorescent lamp (EEFL), a flat fluorescent lamp (FFL), or some other lamp. In alternative embodiments, the load could include a bank of CCFLs, a bank of EEFLs, a bank of FFLs, a bank of some combination of lamps, or any other load. Thus, the CCFL 206 is a specific, non-limiting example of a load.

Figure 3A:
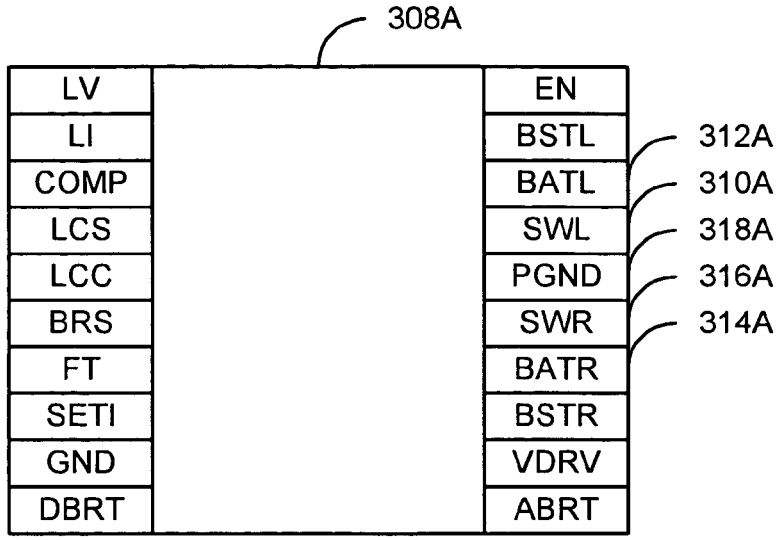
FIGS. 3A and 3B depict pin arrangements in two exemplary fixed-frequency inverters.
Figure 3B:
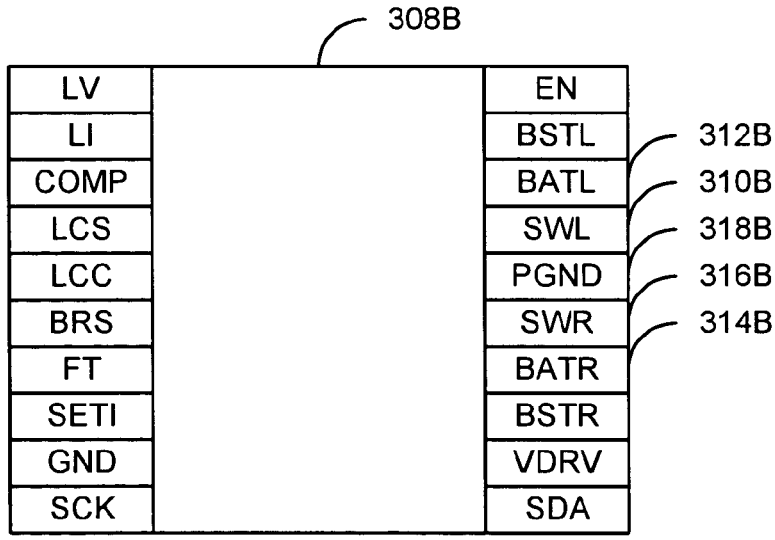

In the example of FIGS. 2A and 2B, the fixed frequency inverter module 208 includes pins 210, 212, 214, 216, and 218. Pin 210 is coupled to the transformer 222 in the resonant tank 204. Pin 212 and pin 214 are coupled to a power source. Pin 216 is coupled to the capacitor 224 in the resonant tank 204. Pin 218 is coupled to ground. The fixed frequency inverter module 208 is a non-limiting example of an inverter module. FIGS. 3A and 3B depict pin arrangements in two alternative fixed frequency inverters 308-A and 308-B. Fixed frequency inverters 308A and 308B are alternative examples that are also non-limiting. Other fixed frequency inverters could be used in alternative embodiments for the same effect. Indeed, the system 200 need not even include a fixed-frequency inverter 208 if some other logic can be used to replicate the desired functionality of such a device.

It may be noted that in the example of FIGS. 2A and 2B, the fixed frequency inverter module 208 includes pins for receiving lamp current feedback (LI), lamp current voltage feedback (LV), and full bridge output bootstrap pins (BSTR and BSTL) for providing gate bias for the driver of internal power transistors. The capacitors respectively between BSTL and pin 210 and between BSTR and pin 216 are charged through an internal switch when the pin 210 or the pin 216 are low. LI, LV, BSTR, and BSTL are optional.

FIGS. 2A and 2B are intended to illustrate a specific, non-limiting example of the system 100 (FIG. 1). Other examples could include different components or configurations.

In operation, in a first phase a voltage enters the fixed frequency inverter module 208 at pin 214. The voltage is converted to, by way of example but not limitation, a square wave signal which is output at pin 216. The square wave signal is received at the capacitor 224, which facilitates conversion of the square wave signal into an analog signal. The analog signal is received at the primary windings of the transformer 222, passed to the secondary windings of transformer 222, and is used to drive the CCFL 206 at a first end of the CCFL 206. The signal from the primary windings of the transformer 222 is received at the pin 210, and passed to pin 218, which is grounded.

In operation, in a second phase a voltage enters the fixed frequency inverter module 208 at pin 212, and the current flow path for a second phase is from pin 212 to pin 210 to the transformer 222 to the capacitor 224 to pin 216 to and to pin 218, which is grounded. In operation, a rest phase current flow path is from pin 210, to the transformer 222, to the capacitor 224, to pin 216, and vice versa. Advantageously, the rest phase current does not flow through pin 218, thus eliminating power loss on a wire bond within Pin 218.

Figure 4A:
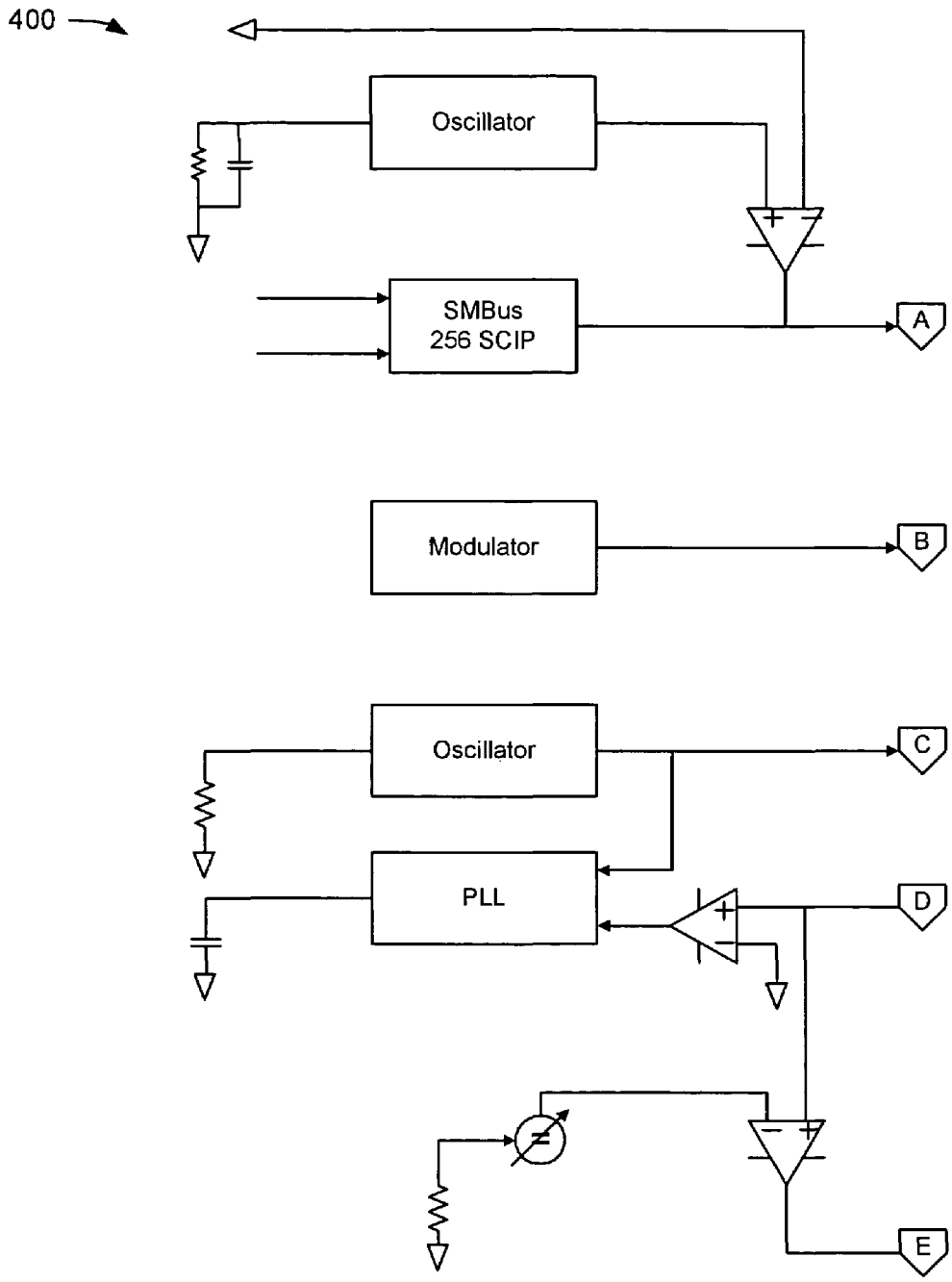
FIGS. 4A and 4B depict an example of an application circuit system.
Figure 4B:
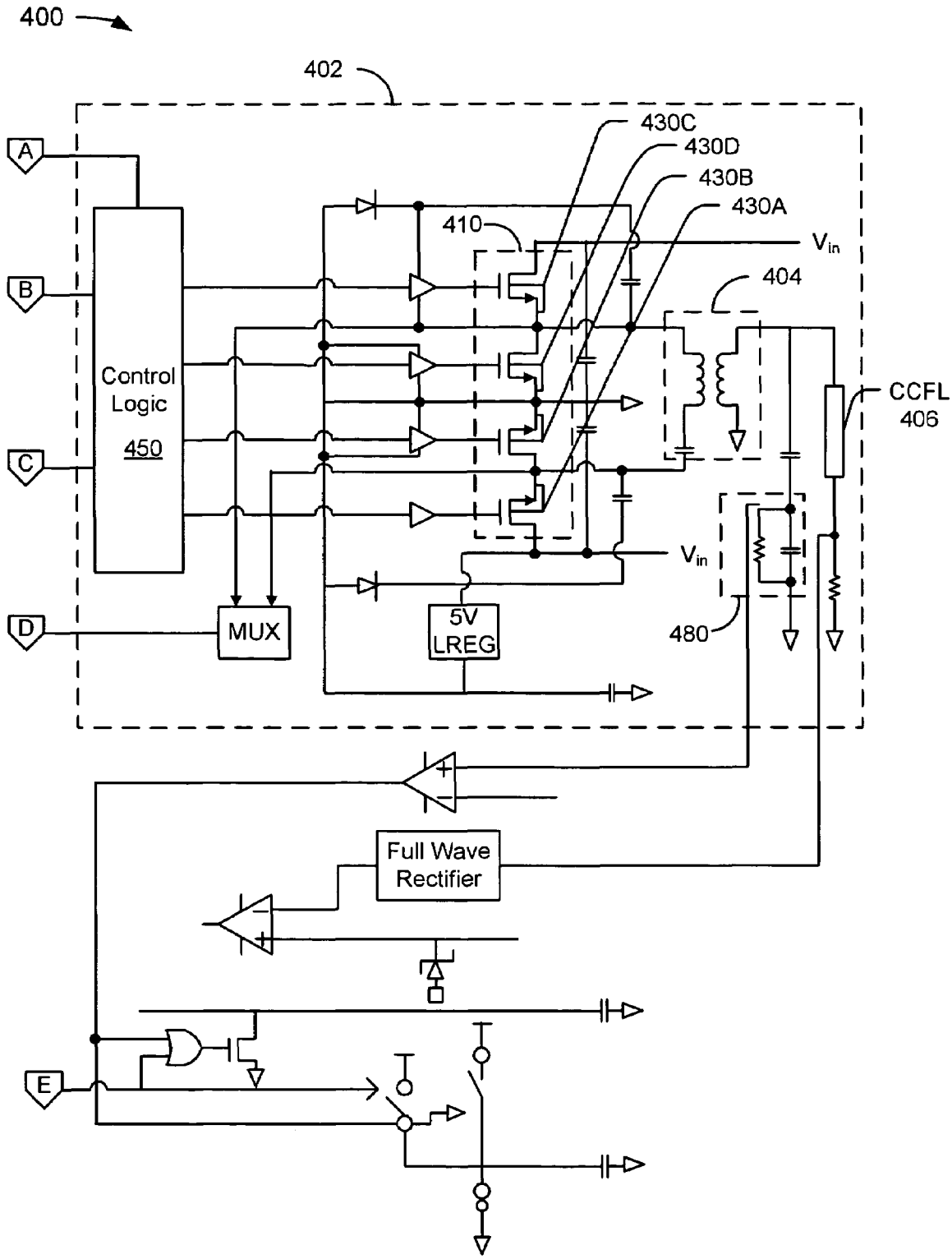

FIGS. 4A and 4B depict an example of an application circuit system 400. The system 400 includes a fixed-frequency inverter-driven CCFL module 402 and other circuit components. In the example of FIGS. 4A and 4B, the module 402 includes a resonant tank 404, a CCFL 406, a switch network 410, a control logic 450, and a parasitic capacitance compensation module 480. The resonant tank module 404 is coupled to the CCFL 406 and to the parasitic capacitance compensation module 480. The switching network 410 is coupled to the resonant tank module 404. The resonant tank module 404 is similar to the resonant tank module 204 (FIG. 2B) described previously. The CCFL 406 is similar to the CCFL 206 (FIG. 2B) described previously.

In the example of FIG. 4B, the switching network 410 includes switches 430A, 430B, 430C, and 430D arranged in series (hereinafter collectively referred to as the switches 430). Switch 430A is coupled to a voltage input from a power source (not shown) and to the resonant tank 404. Switch 430B is coupled to the resonant tank 404 and to ground. Switch 430C is coupled to a voltage input from a power source (not shown) and to the resonant tank 404. Switch 430D is coupled to the resonant tank and to ground.

FIG. 4B depicts a non-limiting example of the switching network 410, which may include other components or configurations in alternative embodiments.

In the example of FIG. 4B, the control logic 450 is coupled to the switches 430 in the switching network 410. The control logic 450 may include any logic effective to open and close switches in the switching network 410 in a manner that is described later with reference to FIGS. 5 to 9.

In the example of FIG. 4B, the parasitic capacitance compensation module 480 includes a capacitor and a resistance. The parasitic capacitance compensation module 480 is an optional component, examples of which are described in a co-pending patent application Ser. No. 11/198,029 entitled METHOD AND APPARATUS FOR DRIVING DISCHARGE LAMPS IN A FLOATING CONFIGURATION, which was filed Aug. 5, 2005, and which is incorporated herein by reference.

In operation, the control logic 450 directs the switches 430 in the switching network 410 to be opened and closed in particular configurations to produce a square waveform voltage signal. The square waveform signal travels from the switching network 410 to the resonant tank 404. The resonant tank 404 produces an analog current from the square waveform signal, which drives the CCFL 406.

Figure 5:
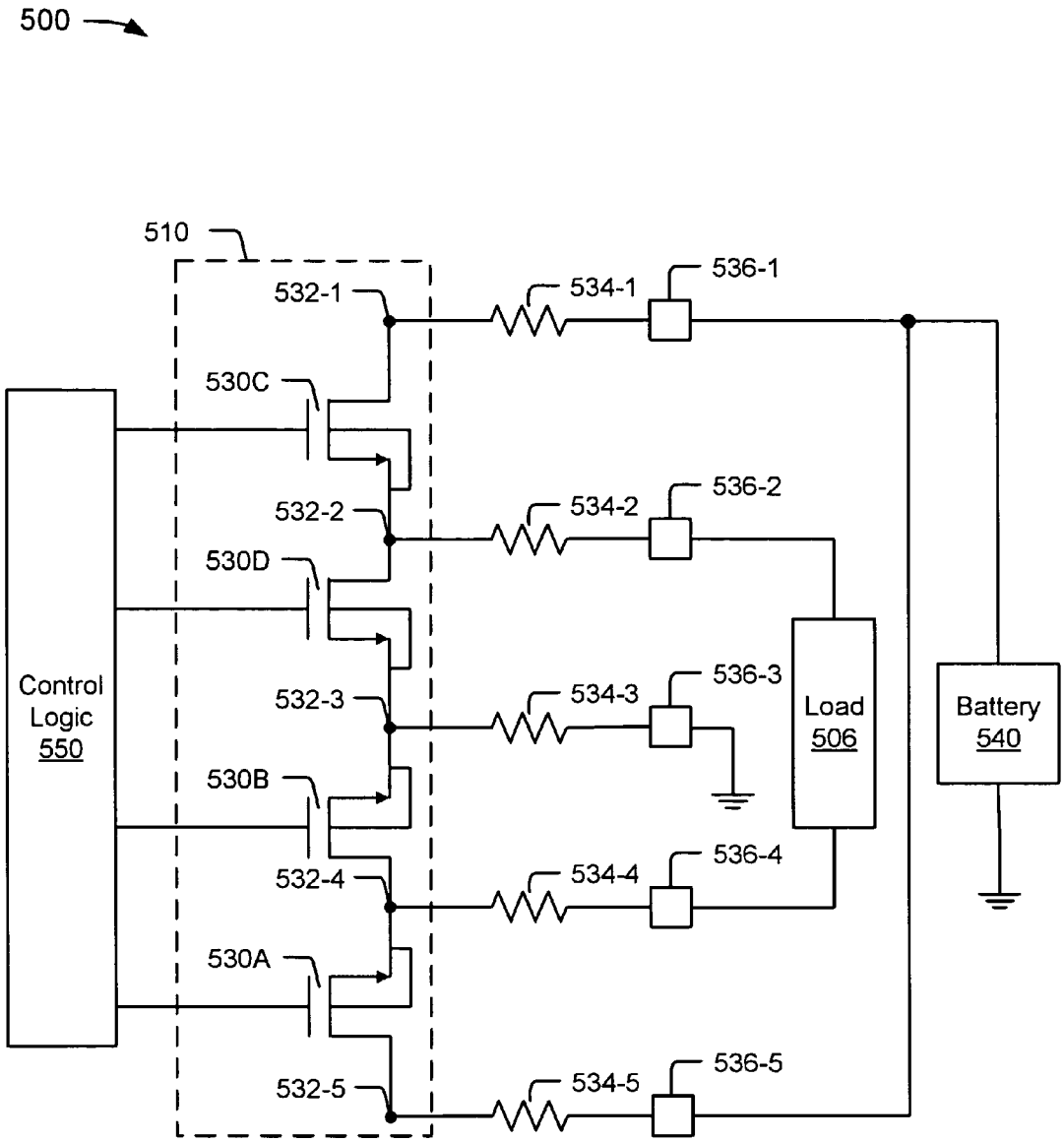
FIG. 5 depicts an example of an application circuit system with serially arranged transistors.

FIG. 5 depicts an example of an application circuit system 500 with serially arranged transistors. The example of FIG. 5 includes a load 506, four transistors 530A, 530B, 530C, and 530D (hereinafter referred to collectively as the transistors 530), five pads 532-1, 532-2, 532-3, 532-4, and 532-5 (hereinafter referred to collectively as the pads 532), five bond wires 534-1, 534-2, 534-3, 534-4, and 534-5 (hereinafter referred to collectively as the bond wires 534), five pins 536-1, 536-2, 536-3, 536-4, and 536-5 (hereinafter referred to collectively as the pins 536), a battery 540, and a control logic 550. The load 506 is coupled to pin 536-2 and pin 536-4. The transistor 530A is coupled to pads 532-4 and 532-5. The transistor 530B is coupled to pads 532-3 and 532-4. The transistor 530C is coupled to pads 532-1 and 532-2. The transistor 530D is coupled to pads 532-2 and 532-3. Pad 532-1 is coupled to bond wire 534-1, which is coupled to pin 536-1. Pad 532-2 is coupled to bond wire 534-2, which is coupled to pin 536-2. Pad 532-3 is coupled to bond wire 534-3, which is coupled to pin 536-3. Pad 532-4 is coupled to bond wire 534-4, which is coupled to pin 536-4. Pad 532-5 is coupled to bond wire 534-5, which is coupled to pin 536-5. The pins 536-1 and 536-5 are coupled to the battery 540. The control logic 550 is coupled to the transistors 530. The configuration shown is a non-limiting example. Other examples could include different components or configurations.

In operation, the transistors 530 act as switches. The control logic 550 is effective to open and close each of the transistors 530 in a manner discussed in more detail later with reference to FIGS. 7A to 7C.

Figure 6:
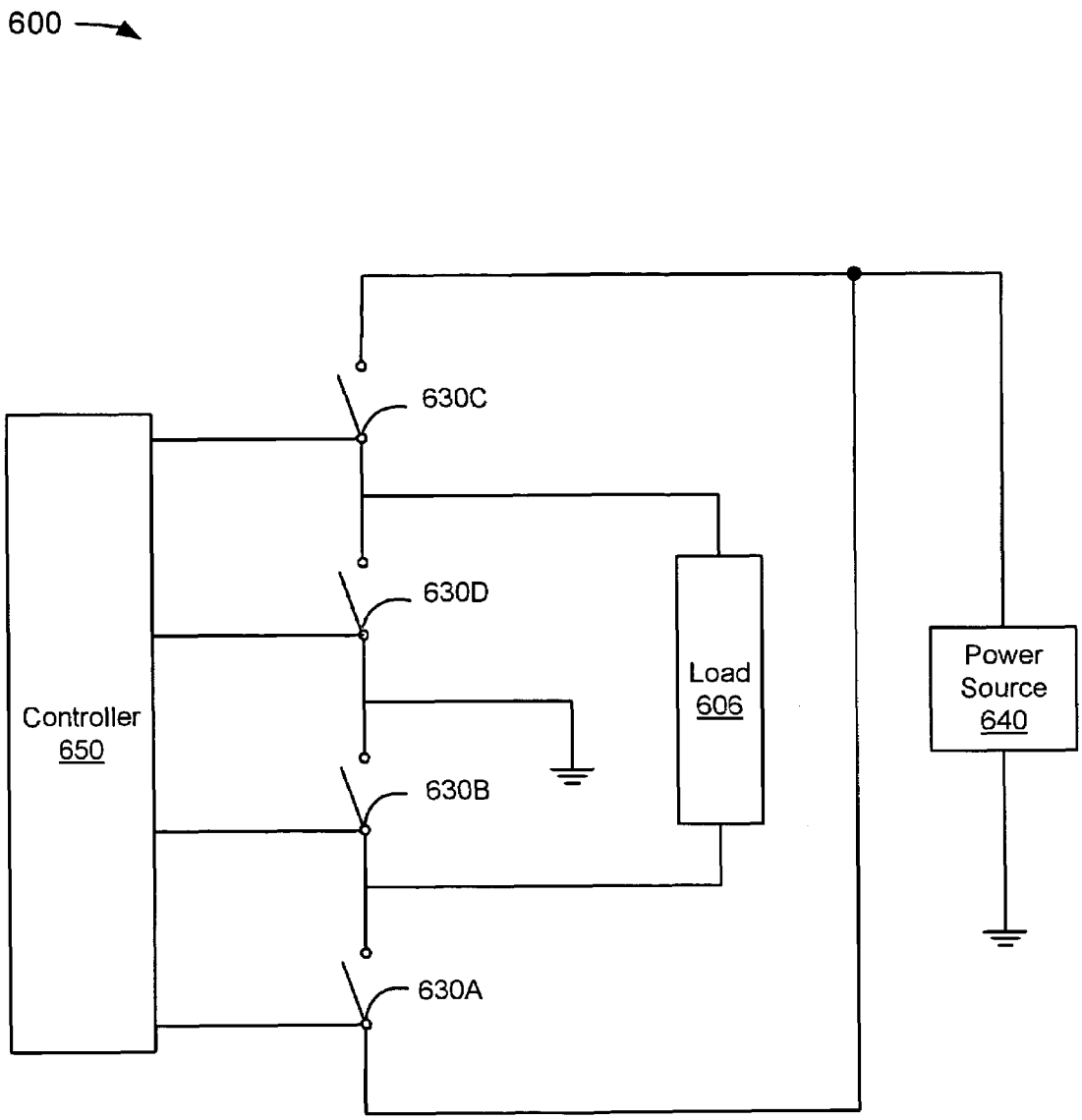
FIG. 6 depicts an example of an application circuit system with serially arranged switches.

FIG. 6 depicts an example of an application circuit system 600 with serially arranged switches. In the example of FIG. 6, the system 600 includes a load 606, switches 630A, 630B, 630C, and 630D (hereinafter collectively referred to as the switches 630), a power source 640, and a controller 650. The switches 630 may include any applicable switching mechanism that allows opening and closing of the switch. The load 606 is coupled to each of the switches 630. The controller 650 is coupled to each of the switches 630. The power source 640 is operationally connected to the switches 630A, 630C and the switches 630B, 630D are operationally connected to ground. In addition, the switch 630A is serially coupled to the switch 630B, the switch 630B is serially coupled between the switch 630A and the switch 630D, and the switch 630D is serially coupled between the switch 630B and the switch 630C. The configuration shown is a non-limiting example. Other examples could include different components or configurations.

In operation, the controller 650 is effective to open and close the switches 630 in order to produce a square wave voltage signal from the power source 640. The square wave voltage signal may be converted into, by way of example but not limitation, an analog signal for driving the load 606. Three exemplary configurations of the switches 630 with respect to being open and closed according to an aspect of an embodiment are discussed in more detail later with reference to FIGS. 7A, 7B, and 7C.

Figure 7A:
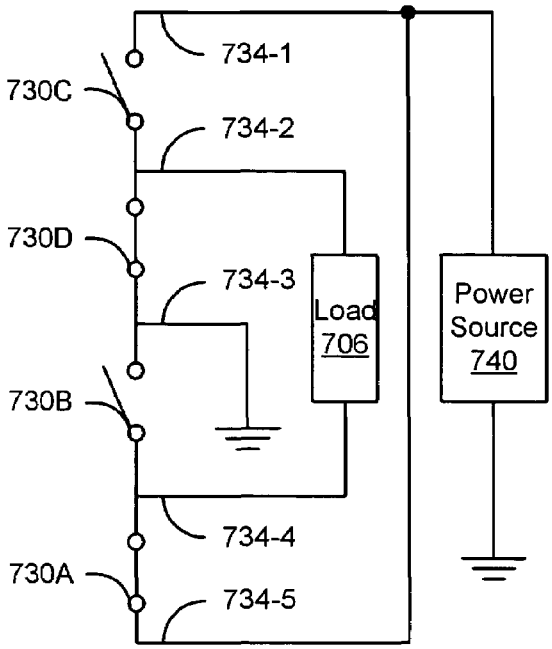
FIGS. 7A, 7B, and 7C depict switch configurations in first, second, and third respective phases.
Figure 7B:
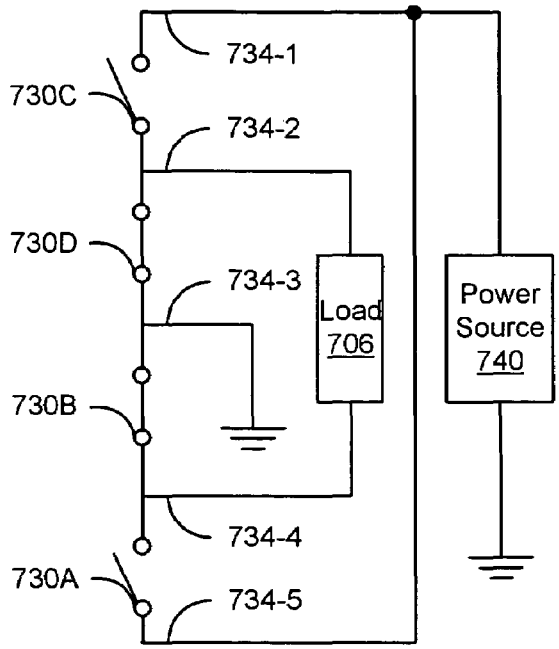
Figure 7C:
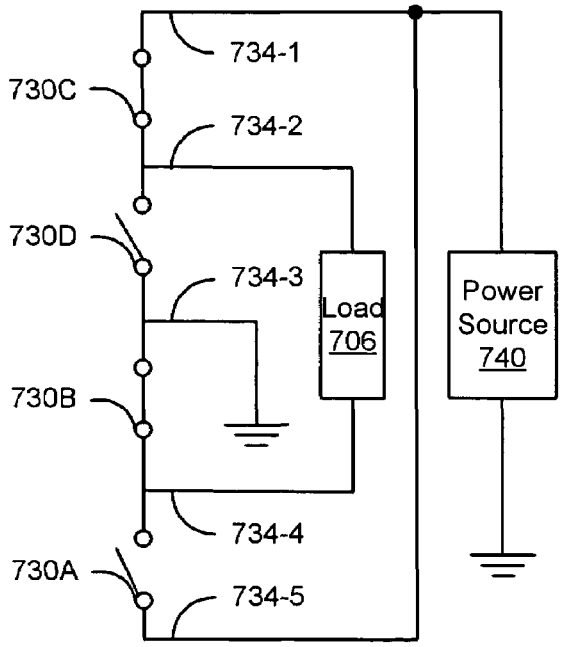

FIGS. 7A, 7B, and 7C depict switch configurations in first, second, and third respective phases. The example configurations of switches in FIGS. 7A, 7B, and 7C include a load 706, switches 730A, 730B, 730C, and 730D (hereinafter collectively referred to as the switches 730), bond wires 734-1, 734-2, 734-3, 734-4, and 734-5 (hereinafter collectively referred to as the bond wires 734), and a power source 740. The switches 730 are serially arranged and may be similar to the switches 630 (FIG. 6) described previously. The bond wire 734-1 is coupled between the power source 740 and the switch 730C. The bond wire 734-2 is coupled between the load 706 and the switches 730C, 730D. The bond wire 734-3 is coupled between ground and the switches 730D, 730B. Bond wire 734-4 is coupled between the load 706 and the switches 730B, 730A. Bond wire 734-5 is coupled between the power source 740 and the switch 730A. The configuration shown is a non-limiting example. Other examples could include different components or configurations.

Figure 8:
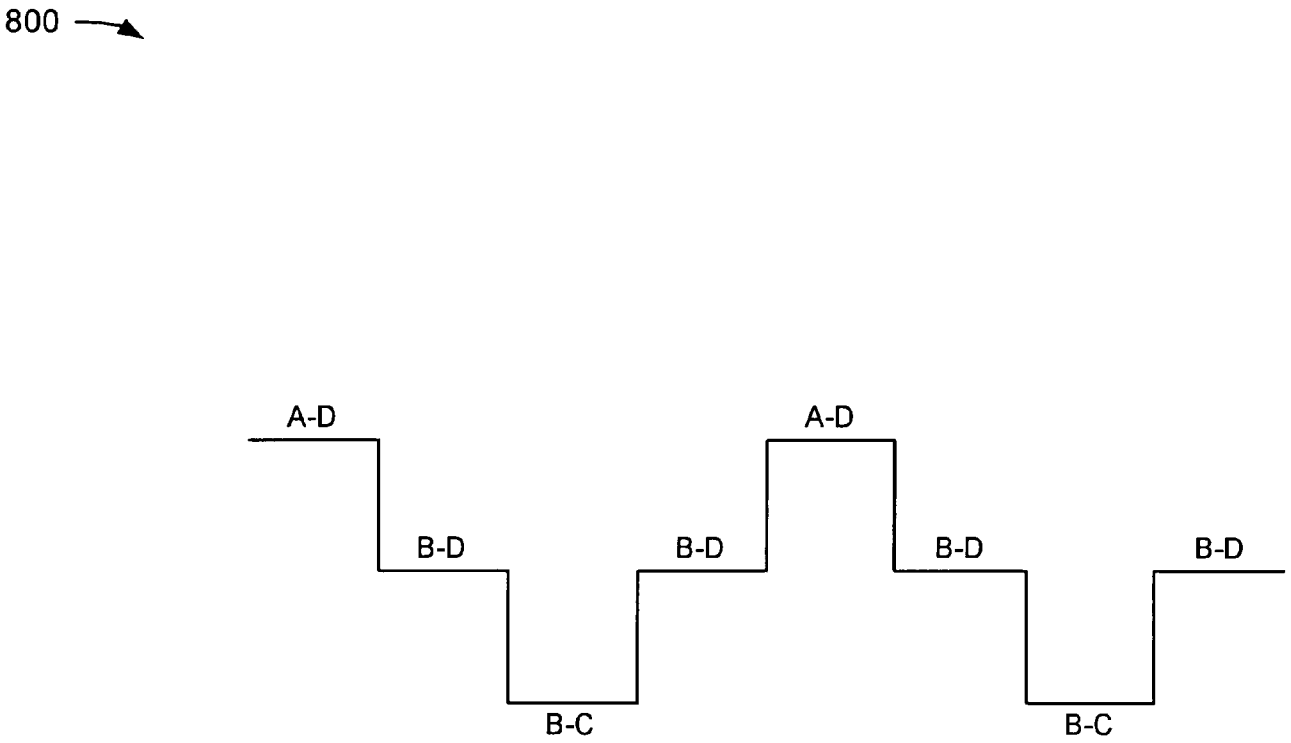
FIG. 8 depicts an example of a voltage waveform produced when switch configurations change as shown in FIGS. 7A, 7B, and 7C.

In operation, a square voltage waveform is produced by cycling the switches between three configurations in the following order: (A-D), (B-D), (B-C), and (B-D). FIG. 8 depicts an example of a voltage waveform 800 produced when switch configurations change as shown in FIGS. 7A, 7B, and 7C. FIG. 7A depicts the (A-D) configuration that corresponds to the (A-D) portion of the voltage waveform 800. FIG. 7B depicts the (B-D) configuration that corresponds to the (B-D) portion of the voltage waveform 800. FIG. 7C depicts the (B-C) configuration that corresponds to the (B-C) portion of the voltage waveform 800.

In the example of FIG. 7A, switch 730A is closed, 730B is open, 730C is open, and 730D is closed. In this configuration, a signal will travel from the power source 740 through bond wire 734-5, switch 730A, bond wire 734-4, load 706 (driving the load 706 thereby), bond wire 734-2, switch 730D, and bond wire 734-3 to ground.

In the example of FIG. 7B, switch 730A is open, switch 730B is closed, switch 730C is open, and switch 730D is closed. This configuration is a "rest" configuration that is depicted as (B-D) in FIG. 8. At rest, there may be resonant current that flows through the bond wires 734-2, 734-3, and 734-4. Notably, the resonant current only flows through the bond wire 734-3 to reach ground.

In the example of FIG. 7C, switch 730A is open, switch 730B is closed, switch 730C is closed, and switch 730D is open. In this configuration, a signal will travel from the power source 740 through bond wire 734-1, switch 730C, bond wire 734-2, load 706 (driving the load 706 thereby), bond wire 734-4, switch 730B, and bond wire 734-3 to ground.

Figure 9:
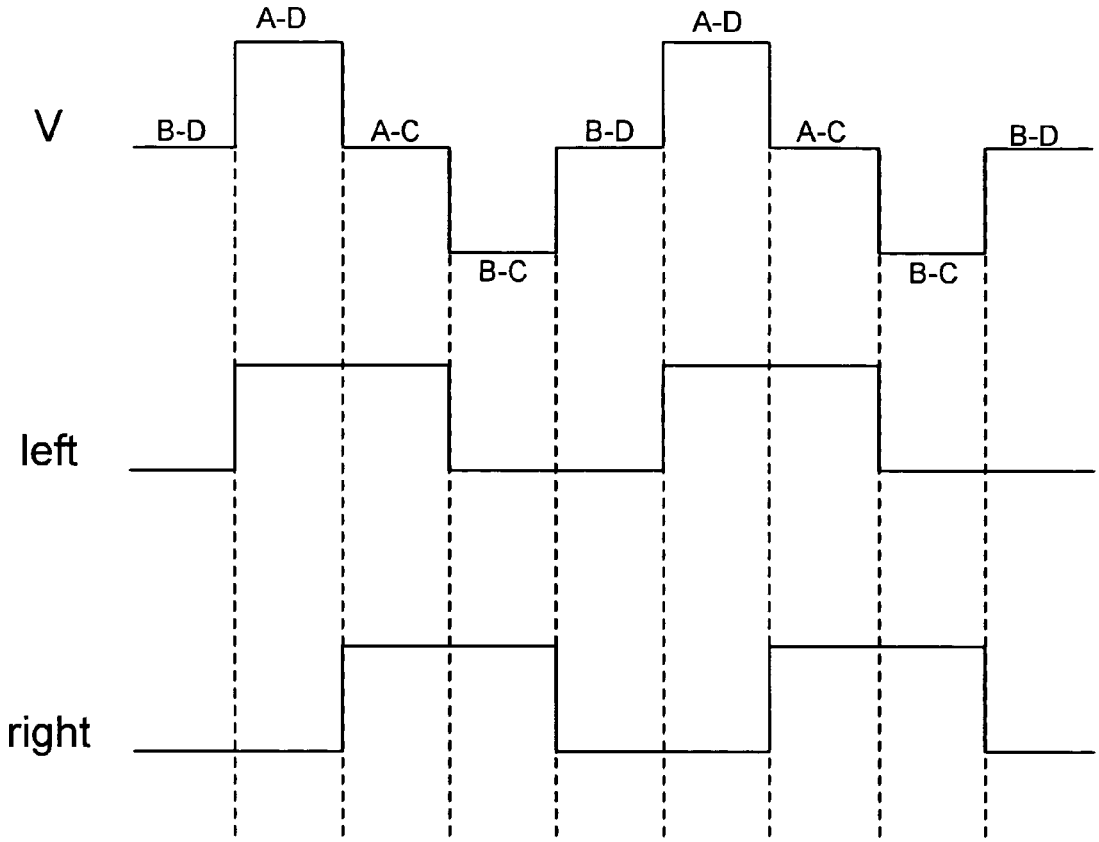
FIG. 9 depicts an alternative voltage waveform.

In an alternative embodiment, other waveforms may be created using a variable number of phases, as depicted in FIG. 9. A square voltage waveform is produced as shown in FIG. 9 by cycling the switches between four configurations in the following order: (B-D), (A-D), (A-C), and (B-C). The (B-C) configuration is obtained by having switch 630A open, switch 630B closed, 630C closed, and 630D open. Other waveforms and switch configurations could be used in alternative aspects or embodiments.

Figure 10A:
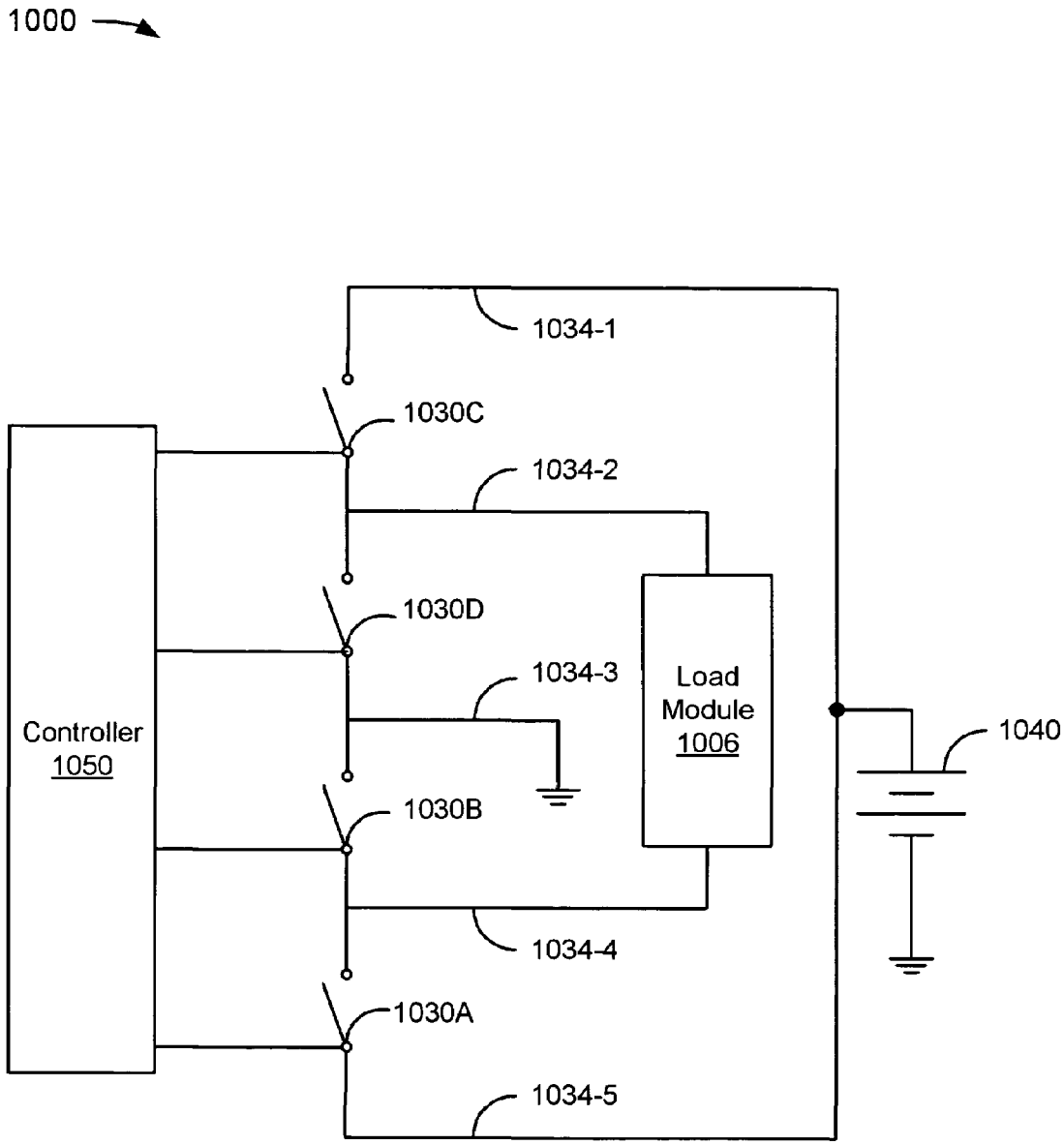
FIG. 10A to 10E depict an example of a system and various alternative load modules.

FIG. 10A to 10E depict an example of a system 1000 and various alternative load modules. In the example of FIG. 10A, the system 1000 includes a load module 1006, switches 1030A, 1030B, 1030C, and 1030D (hereinafter collectively referred to as the switches 1030), wire bonds 1034-1, 1034-2, 1034-3, 1034-4, and 1034-5 (hereinafter collectively referred to as the wire bonds 1034), a power source 1040, and a controller 1050. The wire bonds 1034 couple power devices to external circuit elements, including the load module 1006, the power source 1040, and ground.

In operation, the control schemes or drive waveforms associated with the system 1000 can be similar to the waveforms shown in FIGS. 8 and 9, or can be some other waveform. In the resting phase (B-D), the switches 1030D and 1030B conduct the resting phase current. The current does not need to flow through ground and wire bond 1034-3. Therefore, loss in the wire bond 1034-3 is eliminated. The system 1000 can drive a load module 1006 for different applications. FIGS. 10B to 10E depict examples of load module 1006 configurations.

Figure 10B:
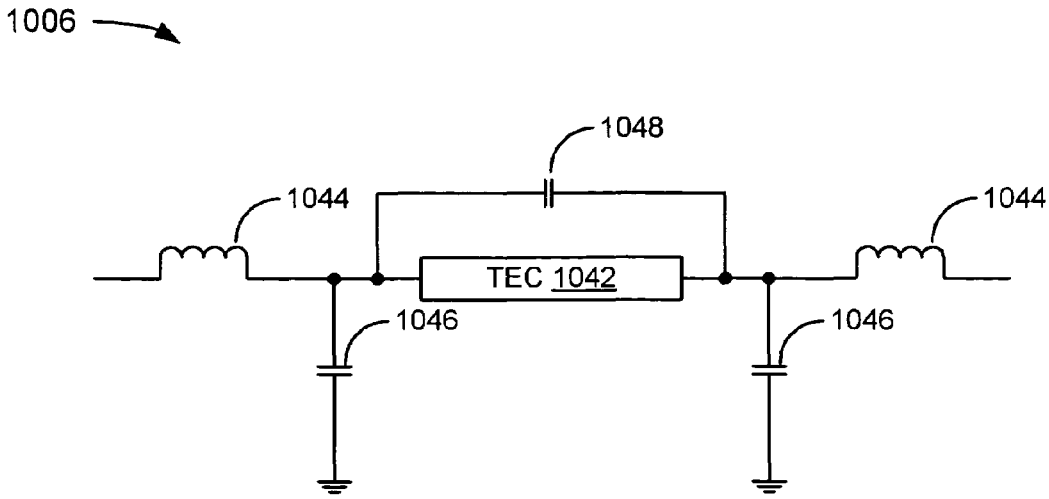

In the example of FIG. 10B, the load module 1006 includes a thermal electric cooler (TEC) 1042. Inductors 1044 and capacitors 1046 form the low pass filter to filter out both differential and common mode noises on the terminals of TEC 1042 while the optional capacitor 1048 further attenuates the differential mode noise.

Figure 10C:
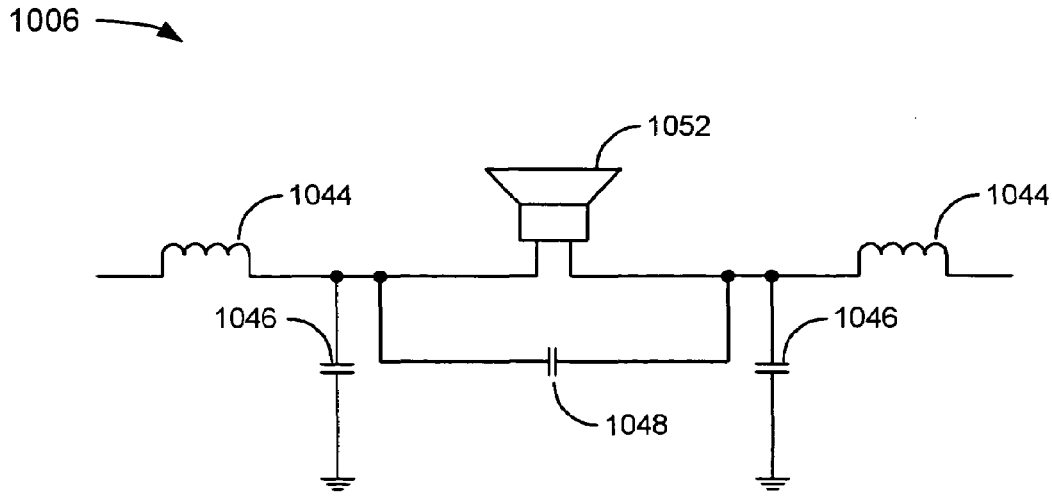

In the example of FIG. 10C, the load module 1006 includes a class D audio amplifier 1052. The components depicted in the example of FIG. 10C are similar to those of FIG. 10B. In addition, for class D audio amplifiers used in the portable devices such as cell phones, the capacitors 1046 and 1048 may or may not be used and the inductors 1044 can be replaced by bead inductors (not shown) or removed completely.

Figure 10D:
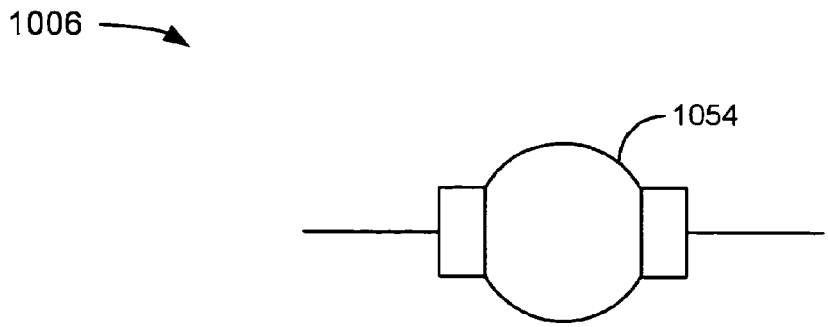

In the example of FIG. 10D, the load module 1006 includes a motor 1054.

Figure 10E:
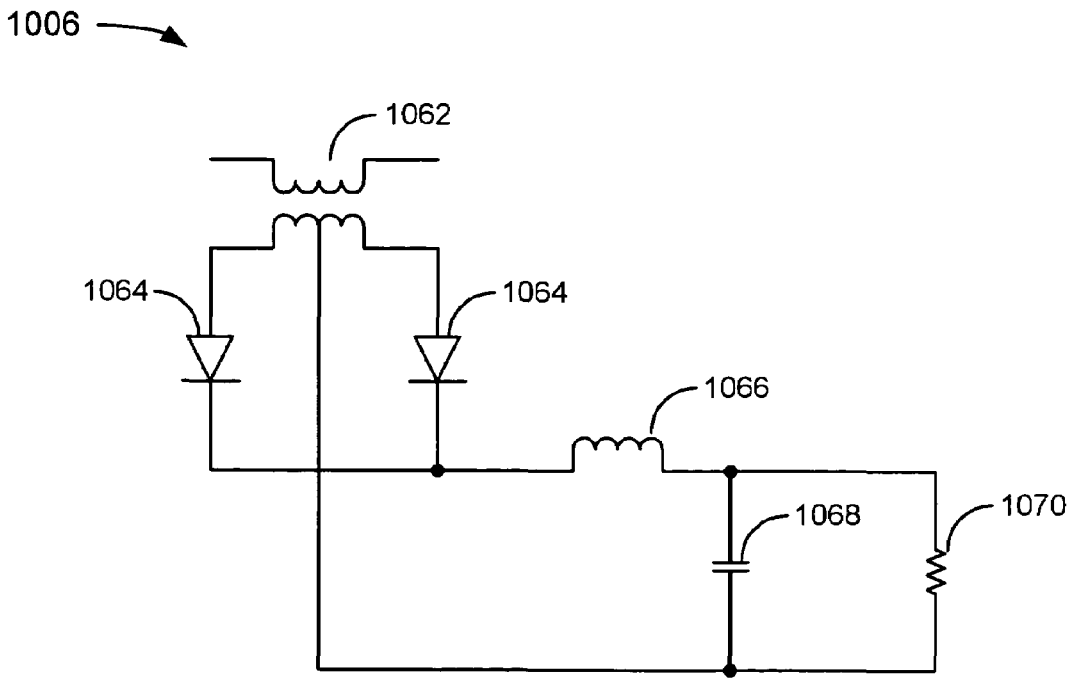

In the example of FIG. 10E, the load module 1006 includes a transformer 1062 with center-tapped rectifier configuration. Other isolated dc/dc topologies include, by way of example but not limitation, full bridge secondary rectifier, current doubler rectifier, multiple transformer rectifier, and other topologies. The transformer 1062 is used to step up or down a square wave voltage applied on the primary winding. Diodes 1064 rectify the secondary winding voltages. Inductor 1066 and capacitor 1068 filter out the ac ripple and provide an essential dc voltage to power the load 1070. The load module 1006 may be effective in isolated dc/dc applications.

Figure 11A:
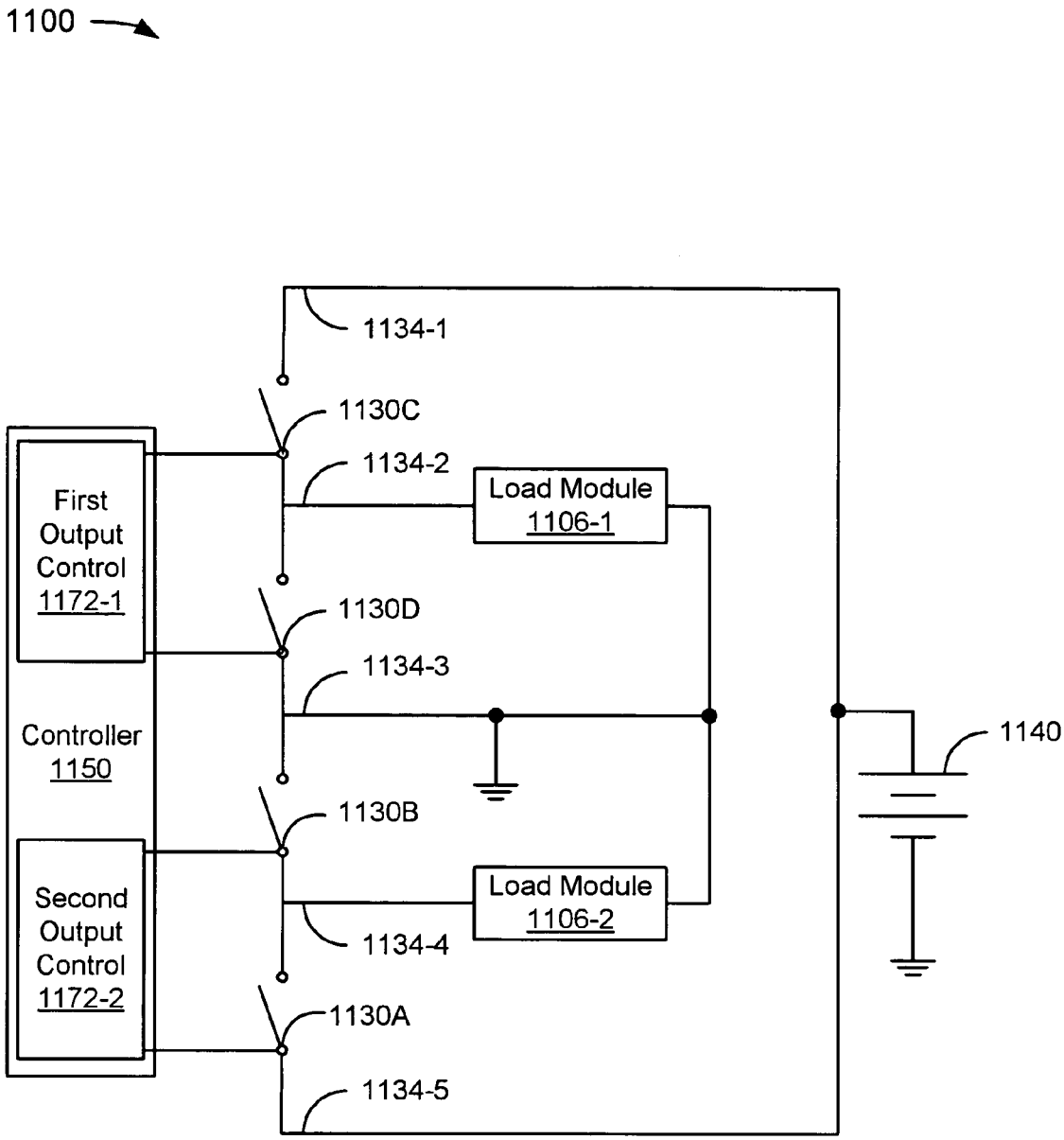
FIGS. 11A to 11D depict an example of a circuit with a dual output configuration.

FIGS. 11A to 11D depict an example of a circuit 1100 with a dual output configuration. In the example of FIG. 11A, the circuit 1100 includes load modules 1106-1 and 1106-2, switches 1130A, 1130B, 1130C, and 1130D (hereinafter collectively referred to as the switches 1130), wire bonds 1134-1, 1134-2, 1134-3, 1134-4, and 1134-5 (hereinafter collectively referred to as the wire bonds 1134), a power source 1140, and a controller 1150. The wire bonds 1134 couple the switches 1130 to other circuit elements including the load modules 1106-1 and 1106-2, the power source 1140, and ground. The controller 1150 may include a first output control logic 1172-1 and a second output control logic 1172-2 for respectively controlling the load modules 1106-1 and 1106-2. In alternative embodiments, more a configuration with more than two outputs and load modules could be used.

Figure 11B:
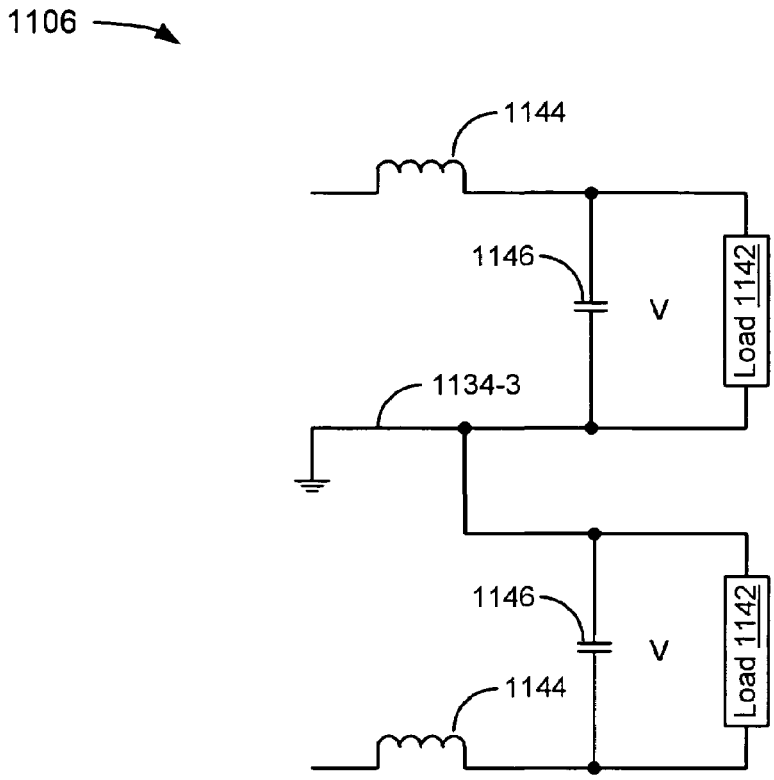

FIG. 11B depicts an example of a circuit that includes dual step down synchronous buck converters. Inductors 1144 and capacitors 1146 filter a square wave into the essential dc voltage V to power respective loads 1142.

Figure 11C:
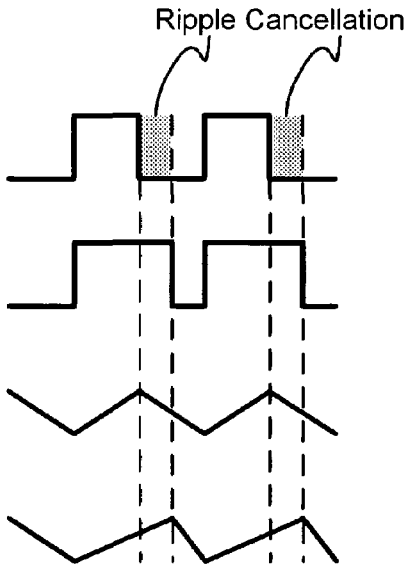
Figure 11D:
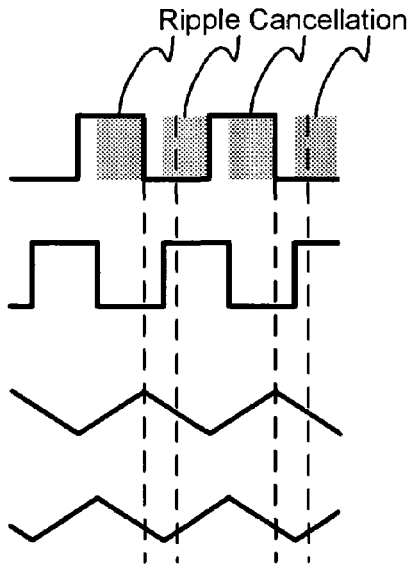

FIGS. 11C and 11D show two exemplary operation waveforms: in phase operation in the example of FIG. 11C and out of phase operation in the example of FIG. 11D. The power loss reduction on the wire bond 1134-3 can be realized in several ways. When one of the loads sinks current and the other sources current, the bond wire (or circuit trace) 1134-3 only conducts the difference between these two currents. Thus the conduction loss is substantially reduced. A typical example for such applications includes the termination supply for the double date rate (DDR) memory, which must sink or source the current. Even if both load devices draw dc current in the same direction, the wire bond 1134-3 only conducts one inductor current in the shaded area shown in FIG. 11C and FIG. 11D and thus the proper phasing technique shown in FIG. 11D can also reduce the dc conductor loss.

Figure 12:
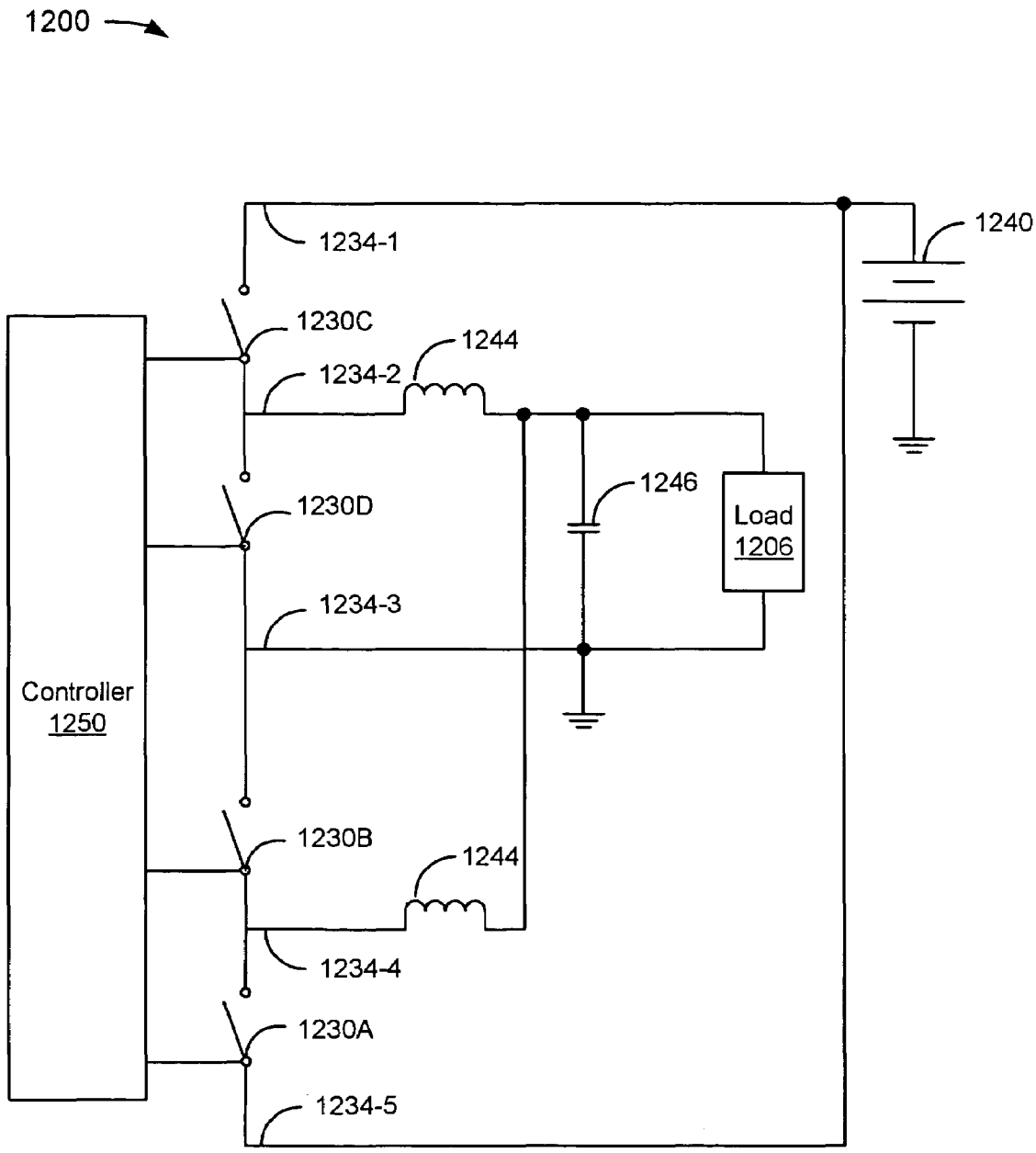
FIG. 12 depicts an example of a circuit having connected dual outputs.

FIG. 12 depicts an example of a circuit 1200 having connected dual outputs. The example of FIG. 12 is similar to that of FIG. 11A, where both outputs are connected together to power a single load. In the example of FIG. 12, the circuit 1200 includes load 1206, switches 1230A, 1230B, 1230C, and 1230D (hereinafter collectively referred to as the switches 1230), wire bonds 1234-1, 1234-2, 1234-3, 1234-4, and 1234-5 (hereinafter collectively referred to as the wire bonds 1234), a power source 1240, inductors 1244, a capacitor 1246, and a controller 1250. This configuration may be used to deliver high current output for, by way of example but not limitation, CPUs or memory banks in a computer. In an embodiment that adopts, for example, the out of phase operation shown in FIG. 11D, the anti-phase technique can substantially reduce power losses in a wire bond or circuit trace 1234-3.

Figure 13:
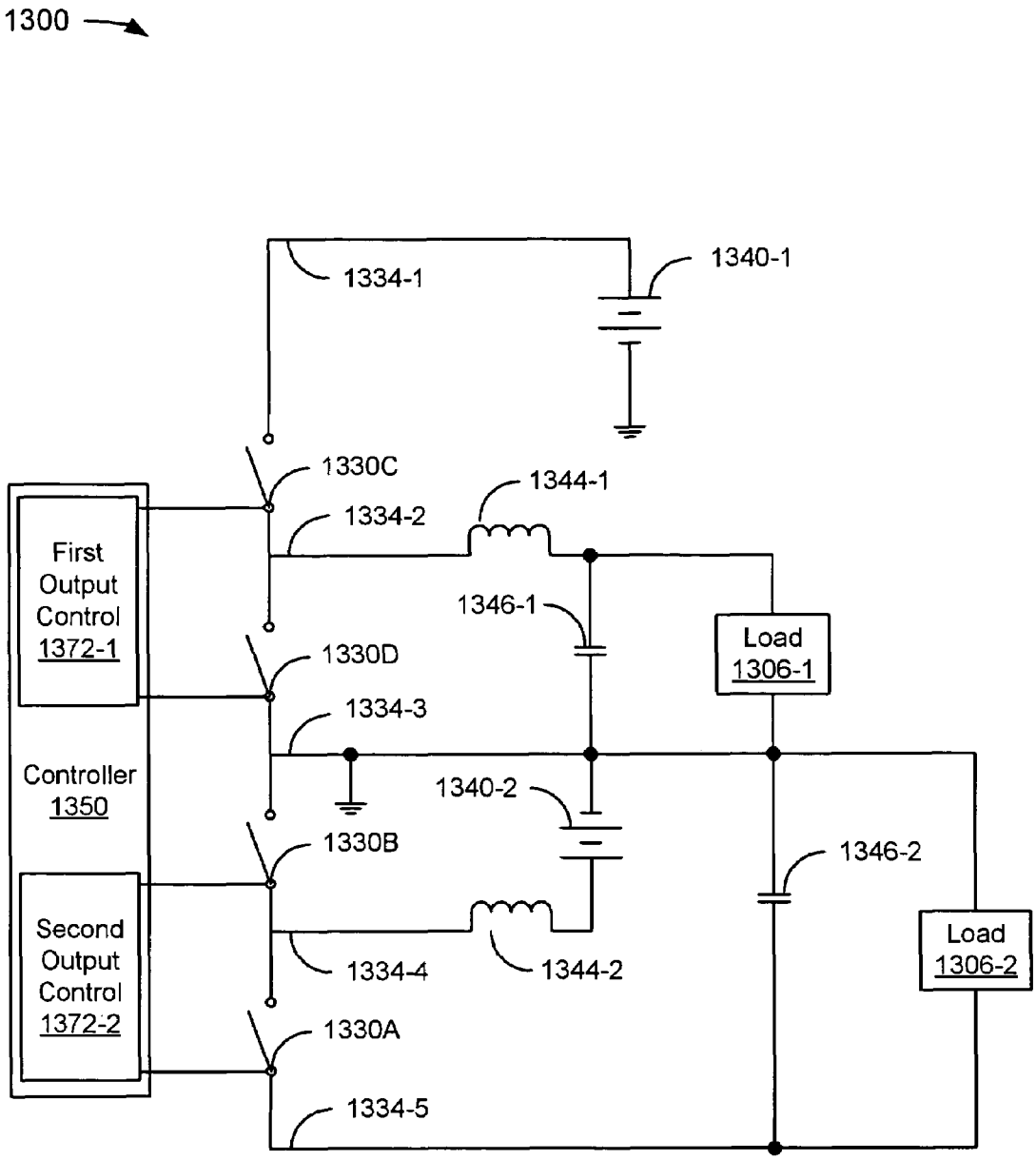
FIG. 13 depicts an example of a circuit for dual output dc/dc voltage conversion applications.

FIG. 13 depicts an example of a circuit 1300 for dual output dc/dc voltage conversion applications. In the example of FIG. 13, the circuit 1300 includes loads 1306-1 and 1306-2, switches 1330A, 1330B, 1330C, and 1330D (hereinafter collectively referred to as the switches 1330), wire bonds 1334-1, 1334-2, 1334-3, 1334-4, and 1334-5 (hereinafter collectively referred to as the wire bonds 1334), power sources 1340-1 and 1340-2, inductors 1344-1 and 1340-2, capacitors 1346-1 and 1346-2, and a controller 1350.

In the example of FIG. 13, in an embodiment, the switches 1330A and 1330B, inductor 1342-1 and capacitor 1346-1 form a synchronous boost converter that receives input from power source 1340-1 and produces output for the load 1306-1. Power switches 1330C and 1330D, inductor 1342-2, and capacitor 1346-2 form the synchronous buck converter that steps down the voltage receiving from power source 1340-2 and provides output to load 1306-2. When switches 1330D and 1330B conduct at the same time, the difference between the two inductor currents flows through 1334-3, thus reducing the power loss on 1334-3. With proper phase technique in the driving waveforms, the common conduction time for 1330D and 1330B are maximized to minimize the power loss on 1334-3.

It will be appreciated to those skilled in the art that the preceding examples and embodiments are exemplary and not limiting to the scope of the present invention. It is intended that all permutations, enhancements, equivalents, and improvements thereto that are apparent to those skilled in the art upon a reading of the specification and a study of the drawings are included within the true spirit and scope of the present invention. It is therefore intended that the following appended claims include all such modifications, permutations and equivalents as fall within the true spirit and scope of the present invention.

What is claimed is:

1. A system comprising:

a first pin, a second pin, a third pin, a fourth pin and a fifth pin, wherein the first pin and the fifth pin are operationally coupled to a power source, the second pin and the fourth pin are operationally connected to a load and the third pin is operationally connected to ground;

a controller, coupled to the first pin, the second pin, the third pin, the fourth pin, and the fifth pin, that is effective to:

drive the load with a first potential in a first phase, wherein in the first phase current passes through the first pin and the third pin;

rest in a second phase; and drive the load with a second potential in a third phase, wherein the current passes through the fifth pin and third pin;

wherein the controller is effective to convert direct current from the power source into alternating current that is applied to the load through the second pin and the fourth pin.

2. The system of claim 1, further comprising:

a bond wire operationally connecting the third pin to ground;

a battery having a first battery terminal operationally connected to the first pin and a second battery terminal operationally connected to the fifth pin, wherein in a first phase current passes from the first battery terminal to ground through the bond wire, in a second phase resonant current passes to ground through the bond wire, and in a third phase current passes from the second battery terminal to ground through the bond wire.

3. The system of claim 1, wherein the load is a lamp selected from the group consisting of a Cold Cathode Fluorescent Lamp (CCFL), an External Electrode Fluorescent Lamp (EEFL), and a Flat Fluorescent Lamp (FFL).

4. The system of claim 1, in which the load is in a floating point configuration.

5. The system of claim 1, wherein in the second phase, a resonant current passes to ground through the third pin.

6. The system of claim 5, wherein minimized power loss occurs in the second phase wherein a resonant current flows through the second pin, the third pin, and the fourth pin.

7. The system of claim 1, wherein direct current flows through the first pin and the fifth pin.

8. The system of claim 1, further comprising:

a switching network having four serially arranged switches wherein the switching network is operationally connected to the power source and to the controller, wherein the controller opens and closes the four serially arranged switches in the switching network so as to produce an alternating square wave signal;

a resonant tank module, operationally connected between the switching network and the load, that converts the alternating square wave signal into the alternating current that is applied to the load.

9. The system of claim 1, wherein the switches of the switching network include transistors.

10. The system of claim 1, wherein:

a first switch is connected to the first pin and to the second pin;

a second switch is connected to the second pin and to the third pin;

a third switch is connected to the third pin and to the fourth pin;

a fourth switch is connected to the fourth pin and to the fifth pin, wherein zero voltage is applied to the load when the first switch is open, the second switch is closed, the third switch is closed, and the fourth switch is open with current flowing through the second pin, the third pin, and the fourth pin.

11. The system of claim 1, wherein:

a first switch is connected to the first pin and to the second pin;

a second switch is connected to the second pin and to the third pin;

a third switch is connected to the third pin and to the fourth pin;

a fourth switch is connected to the fourth pin and to the fifth pin, wherein:

a first potential is applied to the load when the first switch is open, the second switch is closed, the third switch is open, and the fourth switch is closed;

a second potential is applied to the load when the first switch is closed, the second switch is open, the third switch is closed, and the fourth switch is open.

12. The system of claim 1, further comprising:

a first pad operationally connected to the first pin;

a second pad operationally connected to the second pin;

a third pad operationally connected to the third pin;

a fourth pad operationally connected to the fourth pin; and a fifth pad operationally connected to the fifth pin.

13. The system of claim 12, wherein:

each pad is connected to a bond wire;

each bond wire is connected to a pin;

the first pad and the fifth pad are connected to a battery through respective bond wires;

the third pad is connected to a ground through a bond wire;

the second pad and the fourth pad are connected to a load through respective bond wires.

14. The system of claim 1, wherein the load includes a Cold Cathode Fluorescent Lamp (CCFL), further comprising:

a first switch that is operationally connected to the controller, to the first pin through a bond wire operationally connected to a first terminal of the power source and to the second pin through a first bond wire operationally connected to the CCFL;

a second switch that is operationally connected to the controller, to the second pin through the first bond wire operationally connected to the CCFL and to the third pin through a bond wire operationally connected to ground;

a third switch that is operationally connected to the controller, to the third pin through the bond wire operationally connected to ground and to the fourth pin through a second bond wire operationally connected to the CCFL;

a fourth switch that is operationally connected to the controller, to the fourth pin through the second bond wire operationally connected to the CCFL and to the fifth pin through a bond wire operationally connected to a second terminal of the power source;

wherein the controller is effective to open and close the switches to drive the CCFL with an alternating current, and wherein:

when the first switch is open, the second switch is closed, the third switch is closed, and the fourth switch is open, zero voltage is applied to the CCFL;

when the first switch is open, the second switch is closed, the third switch is open, and the fourth switch is closed, the CCFL is driven with a positive voltage;

when the second switch is open, the third switch is closed, and the fourth switch is open, the CCFL is driven with a negative voltage.

15. A folded full bridge apparatus comprising:

a power source;

a first switch, a second switch, a third switch, and a fourth switch arranged in series wherein the second switch and the third switch are grounded and wherein the first switch and the fourth switch are coupled to the power source;

a controller, coupled to the first switch, the second switch, the third switch and the fourth switch, effective to:

drive, in a first phase, an external load with a first potential through the first switch and the third switch;

rest in a second phase;

drive, in a third phase, the external load with a second potential through the second switch and the fourth switch.

16. The apparatus of claim 15, wherein the external load includes a first load module, said controller further comprising:

a first output control effective to control power to a first load module, wherein the first load module is coupled between the power source and ground;

a second output control effective to control power to a second load module, wherein the second load module is coupled between the power source and ground.

17. The apparatus of claim 15, wherein said apparatus has a dual output configuration.

18. The apparatus of claim 15, wherein:

the first switch is operationally connected to a first pin and to a second pin;

the second switch is operationally connected to a second pin and to a third pin;

the third switch is operationally connected to a third pin and to a fourth pin;

the fourth switch is operationally connected to a fourth pin and to a fifth pin; wherein:

a positive voltage is delivered to the external load when the first switch is open, the second switch is closed, the third switch is open, and the fourth switch is closed/;

zero voltage is applied to the external load when the first switch is open, the second switch is closed, the third switch is closed, and the fourth switch is open;

a negative voltage is delivered to the external load when the first switch is closed, the second switch is open, the third switch is closed, and the fourth switch is open.

19. A method for producing a voltage waveform comprising:

driving, in a first phase, a load with a first current through a ground pin;

resting in a second phase;

driving, in a third phase, the load with a second current, out of phase with the first current, through the ground pin.

20. The method of claim 19, further comprising driving the load with an analog current.

21. A system, comprising:

one or more power sources;

a plurality of load modules, including a first load module and a second load module;

a plurality of switches;

a plurality of wire bonds, including a first wire bond, that operationally couple the switches to the one or more power sources, the plurality of load modules, and ground;

a controller effective to control the switches to operationally couple the one or more power sources to the plurality of load modules and to operationally couple the plurality of load modules to ground;

wherein, in an operational phase, the first bond wire conducts a current that is the difference between currents respectively associated with the first load module and the second load module.

22. The system of claim 21 wherein, in an operational phase, the first load module sinks current and the second load module sources current.

23. The system of claim 21 wherein, in an operational phase, an inductor ripple current cancellation effect reduces high frequency current induced power loss on the first wire bond.

24. The system of claim 21 wherein the one or more power source include at least two power sources effective to respectively drive the first load module and the second load module.

* * * * *